US012241332B1

(12) United States Patent
Ball et al.

(10) Patent No.: US 12,241,332 B1
(45) Date of Patent: Mar. 4, 2025

(54) ISOLATION DEVICE WITH MULTIPLE PRESSURE STAGES TO ISOLATE WELL INTERVAL

(71) Applicant: Halliburton Energy Services, Inc., Houston, TX (US)

(72) Inventors: David Earl Ball, Stafford, TX (US); Marcus Ray Hudson, Pearland, TX (US); Christian Reding, Houston, TX (US); James Cernosek, Richmond, TX (US); Anthony Herman van Zuilekom, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/416,433

(22) Filed: Jan. 18, 2024

(51) Int. Cl.

| | |
|---|---|
| ***E21B 33/124*** | (2006.01) |
| ***E21B 33/13*** | (2006.01) |
| ***E21B 47/06*** | (2012.01) |
| *E21B 7/04* | (2006.01) |

(52) U.S. Cl.
CPC ..... *E21B 33/1246* (2013.01); *E21B 33/13* (2013.01); *E21B 47/06* (2013.01); *E21B 7/046* (2013.01)

(58) Field of Classification Search
CPC . E21B 33/124; E21B 33/1243; E21B 33/1246
See application file for complete search history.

(56) References Cited

U.S. PATENT DOCUMENTS

| | | | | |
|---|---|---|---|---|
| 5,058,673 | A * | 10/1991 | Muller | E21B 33/128 166/187 |
| 6,257,338 | B1 * | 7/2001 | Kilgore | E21B 43/14 166/387 |
| 6,865,933 | B1 * | 3/2005 | Einarson | E21B 49/081 73/864.33 |
| 2009/0183882 | A1 * | 7/2009 | van Zuilekom | E21B 49/081 166/371 |
| 2010/0314124 | A1 * | 12/2010 | Simancas | E21B 33/124 166/51 |

(Continued)

OTHER PUBLICATIONS

PCT/US2024/012098 , "International Search Report and Written Opinion", Oct. 14, 2024, 12 pages.

*Primary Examiner* — Shane Bomar
(74) *Attorney, Agent, or Firm* — Kilpatrick Townsend & Stockton LLP

(57) ABSTRACT

A well interval isolation device is disclosed. The wellbore isolation device may have a plurality of expandable elements that cooperate upon expansion downhole in a wellbore to create multiple isolated well intervals. At least two pairs of expandable elements that are spaced apart on a tool string are usable to create both a primary isolated well interval and at least one isolated guard interval on each of an uphole side and a downhole side of the primary isolated well interval. The isolated guard intervals function to further isolate the primary isolated well interval from surrounding well fluid, thereby allowing a difference between the pressure within the primary isolated well interval and the hydrostatic pressure of the well fluid (i.e., the differential pressure) to safely exceed the maximum differential pressure at which any of the individual expandable elements can operate while simultaneously maintaining isolation of the well intervals.

20 Claims, 5 Drawing Sheets

(56) References Cited

U.S. PATENT DOCUMENTS

| | | | | |
|---|---|---|---|---|
| 2011/0061863 | A1* | 3/2011 | Ramakrishnan | E21B 33/124 166/250.14 |
| 2013/0118751 | A1 | 5/2013 | Landsiedel | |
| 2015/0007985 | A1 | 1/2015 | Gisolf | |
| 2015/0075783 | A1* | 3/2015 | Angman | E21B 33/12 166/308.1 |
| 2015/0096756 | A1 | 4/2015 | Sharma et al. | |
| 2015/0176376 | A1* | 6/2015 | Gisolf | E21B 43/12 166/250.01 |
| 2020/0256769 | A1* | 8/2020 | Al-Yami | E21B 49/082 |
| 2020/0378238 | A1* | 12/2020 | Jones | E21B 49/008 |
| 2023/0091554 | A1* | 3/2023 | Ball | E21B 33/127 166/387 |

* cited by examiner

ISOLATION DEVICE WITH MULTIPLE PRESSURE STAGES TO ISOLATE WELL INTERVAL

TECHNICAL FIELD

The present disclosure relates generally to hydrocarbon well operations, and more particularly although not necessarily exclusively, to increasing the allowable differential pressure between an isolated well interval and surrounding well fluid.

BACKGROUND

In a post-drilling hydrocarbon well operation, a well interval of interest can be isolated from the remainder of the well for various reasons. For example, a well interval may be isolated to perform a fluid extraction (drawdown) operation where well fluid is pulled from the interval for analysis or for other reasons, and whereby the fluid pressure within the interval is resultantly reduced. In another example, a well interval of interest may be isolated to perform a microfracturing or acidizing (overpressure) operation, whereby a pressurized fluid is introduced to the formation within the isolated well interval and the fluid pressure within the interval is resultantly increased. Isolating an open hole well interval is commonly accomplished using a straddle packer device that includes a cooperating pair of inflatable packers. A straddle packer device can be positioned on a tool string that can be used to run the straddle packer to a desired downhole location. After the straddle packer is at the desired downhole location, the inflatable packers may be expanded to isolate the well interval located between the packers from fluid and pressure in other portions of the well.

DETAILED DESCRIPTION

Figure 1:
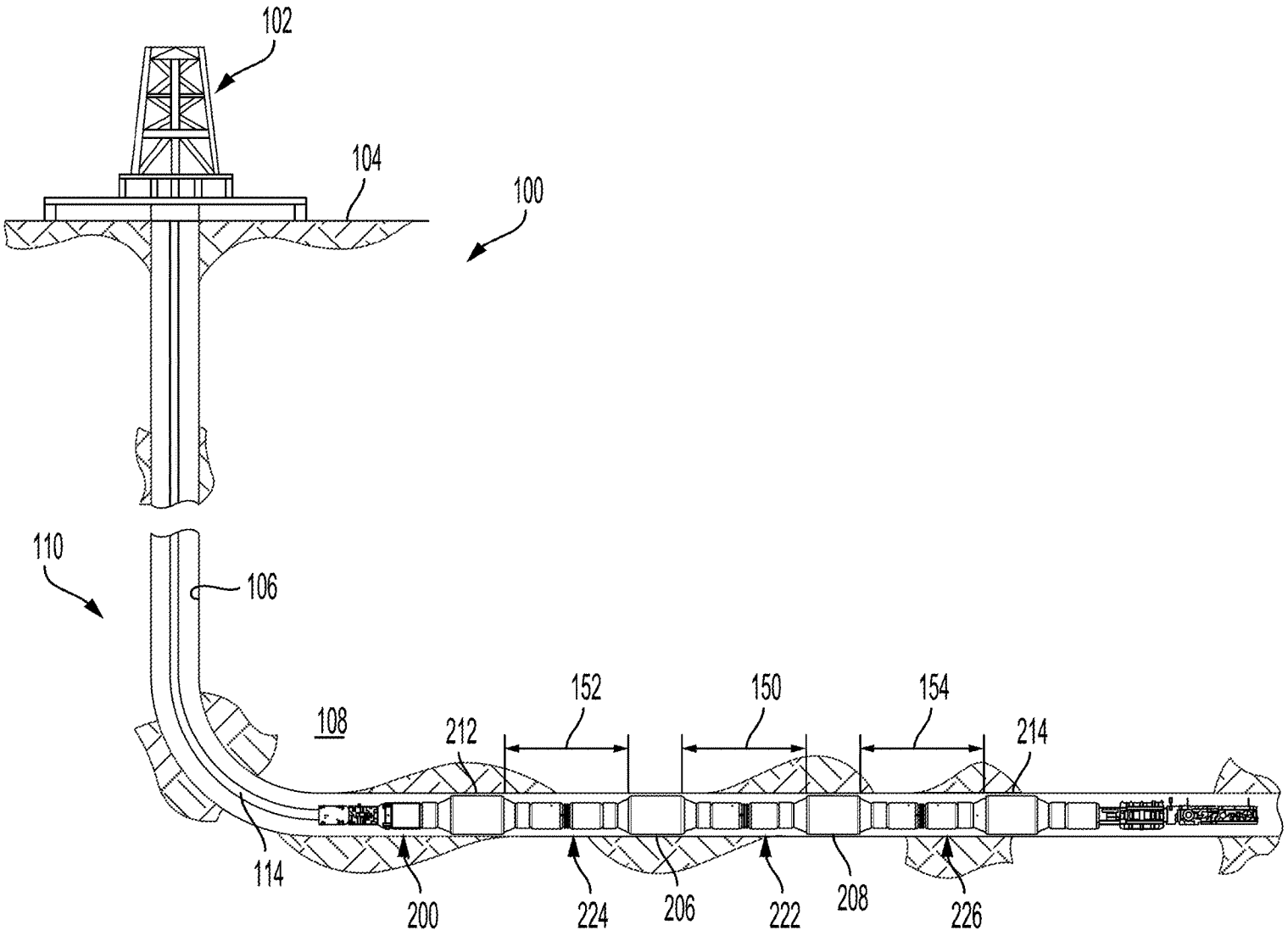
FIG. 1 is a schematic diagram of a hydrocarbon wellbore with a well interval isolation device located therein according to one example of the present disclosure.

Certain aspects and examples of the present disclosure relate to a multiple pressure stage well interval isolation device that can be used to maximize the allowable pressure differential between an isolated well interval and surrounding well fluid during a wellbore operation. The multiple pressure stages of the well interval isolation device may be produced by employing a plurality of expandable elements that are positioned on a tool string in a spaced apart arrangement to create both a primary isolated well interval and at least one isolated guard interval on either side of the primary isolated well interval. Locating the isolated guard intervals on either side of the primary isolated well interval allows a difference in pressure between the primary isolated well interval and the hydrostatic pressure of fluid in the wellbore (i.e., the differential pressure) to safely exceed the maximum differential pressure at which any of the individual expandable elements can operate.

According to various examples, a well interval isolation device is positionable downhole in a wellbore and can include a first, uphole expandable element, and a second, downhole expandable element that are spaced apart on a tool string and cooperate with a primary interval tool to form a primary interval isolating section of the well interval isolation device. In an example, the first expandable element and the second expandable element can be respectively located on opposite (uphole and downhole) sides of the primary isolated interval section of the device. The well interval isolation device can also include at least a third expandable element that may be positioned on the tool string uphole of the first expandable element and can cooperate with the first expandable element and a first uphole guard interval tool to form a first uphole guard interval section. The first uphole guard interval section may be immediately uphole of the of the primary isolated interval section of the well interval isolation device. The well interval isolation device can also include at least a fourth expandable element that may be positioned on the tool string downhole of the second expandable element and can cooperate with the second expandable element and a first downhole guard interval tool to form a first downhole guard interval section of the well interval isolation device. The first downhole guard interval section may be immediately downhole of the of the primary isolated interval section of the well interval isolation device.

The first expandable element and the second expandable element may define a first pair of expandable elements. The third expandable element and the fourth expandable element may define a second pair of expandable elements. The distance between the first expandable element and the second expandable element effectively defines the length of the primary isolated well interval that may be created within a wellbore by the well interval isolation device. The distance between the first expandable element and the third expandable element effectively defines the length of the first uphole guard interval that may be created within a wellbore by the well interval isolation device. Likewise, the distance between the second expandable element and the fourth expandable element effectively defines the length of the first downhole guard interval that may be created within a wellbore by the well interval isolation device.

The pressure within each guard interval can be increased or decreased to coincide with an increase or decrease in pressure within the primary isolated well interval, up to the maximum differential pressure rating of the expandable elements bounding the guard intervals. As such, the first uphole guard interval and the first downhole guard interval further isolate the primary isolated well interval and the first pair of expandable elements from the surrounding well fluid and the hydrostatic pressure associated therewith. This allows for a greater positive or negative pressure within the primary isolated well interval than is possible when only the first pair of expandable elements is present. In other examples, an even greater working differential pressure can be achieved by utilizing further expandable elements to create additional guard intervals uphole of the first uphole guard interval and downhole of the first downhole guard interval.

A well interval isolation device according to some examples may be part of a tool string and may be conveyed relative to a wellbore via tubing, such as straight tubing, coiled tubing, or drill pipe. According to other examples, a well interval isolation device a may be conveyed relative to a wellbore by a wireline or a slickline. In any case, the well interval isolation device can be located or relocated within a wellbore, or removed from a wellbore, by advancing or withdrawing the well interval isolation device using the tubing string, wireline, slickline, etc.

The primary interval tool that resides between the first expandable element and the second expandable element may be any of various types of tools that can be employed to perform different operations. For example, a well interval isolation device may utilize a primary interval tool via which fluid in the primary isolated well interval can be extracted for analysis, or whereby the pressure within the primary isolated well interval can otherwise be reduced by evacuation. In another example, a well interval isolation device may utilize a primary interval tool via which pressurized fluid, a chemical, or another material, can be expelled under pressure into the primary isolated well interval or the formation located within the primary isolated well interval. Such a primary interval tool may be used, for example, to create microfractures in the formation or to stimulate production through chemical injection. In another example, a primary interval tool of a well interval isolation device may be used to perform a focus sampling operation, whereby a target fluid that is encapsulated within another fluid in a wellbore is extracted from the encapsulating fluid.

In operation, a well interval isolation device can be first delivered to a target location within a wellbore that coincides with a well interval of interest. Upon reaching the target location, the expandable elements can be expanded, as described in more detail below, to seal against a wellbore casing or the rock or other formation material forming the wall of an open-hole portion of the wellbore. Upon expansion the expandable elements can create the above-described primary isolated well interval and the uphole and downhole guard intervals. Once created, the pressures within primary isolated well interval and the uphole and downhole guard intervals can be adjusted to maximize the allowable pressure differential between the primary isolated well interval and surrounding well fluid.

Illustrative examples follow and are given to introduce the reader to the general subject matter discussed herein rather than to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

An example of a hydrocarbon well 100 is illustrated in the diagram of FIG. 1. The hydrocarbon well 100 includes a wellbore 106. The wellbore 106 is drilled into a subterranean formation 108 in this example. In other examples, the wellbore 106 can be drilled into a sub-sea formation. The wellbore 106 is shown to include a vertical portion 110 and a horizontal portion 112. In other examples, the horizontal portion 112 may be absent, or a deviated portion may be present. In some examples, the well may be a hydraulic fracturing well. The entirety of the wellbore 106 is depicted in FIG. 1 as an open-hole wellbore for purposes of illustration. In other examples, at least a portion of the wellbore 106 may have a casing installed therein.

One example of a well interval isolation device 200 is located in an open-hole portion of the wellbore 106 in FIG. 1. The well interval isolation device 200 can be used to isolate an interval of interest within the wellbore 106. As shown, this example of the hydrocarbon well 100 includes a rig 102 located at a well surface 104 to convey the well interval isolation device 200 relative to a wellbore 106. In this example, the well interval isolation device 200 is conveyed using tubing 114, but conveyance by drill pipe, a wireline, etc., is also possible. In other examples, the rig 102 can be replaced with a wellhead (e.g., Christmas tree) or another well completion apparatus, and the well interval isolation device may be conveyed relative to the wellbore 106 using a wireline rigup.

During the wellbore drilling operation, drilling fluid ("mud") can be pumped downhole to cool a drill bit. During the wellbore drilling operation, the wellbore 106 may also become partially filled with various fluids that seep into the wellbore 106 from the formation 108. Samples of the fluids present in the wellbore 106 may be extracted for analysis, such as to determine the nature and desirability (e.g., quality) of the fluids present in various portions of the formation 108. Zonal isolation—i.e., isolation of a particular well interval by the well interval isolation device 200—may be used in this regard to help ensure that a fluid sample of interest can be extracted without also extracting nearby fluids, or an excessive volume of nearby fluids.

When a well is a hydraulic fracturing well, it is necessary to fracture the formation in various locations. To optimize fracture placement, and to generally guide the drilling operation and the subsequent casing perforation process, etc., well operators may utilize microfracturing techniques to measure stresses within different portions of the formation. Microfracturing techniques commonly rely on the emission of one or more jets of highly pressurized fluid to create small fractures in the formation 108. As is the case with fluid sampling/extraction, microfracturing operations may be performed within a well interval isolated by the well interval isolation device 200.

Figure 2:
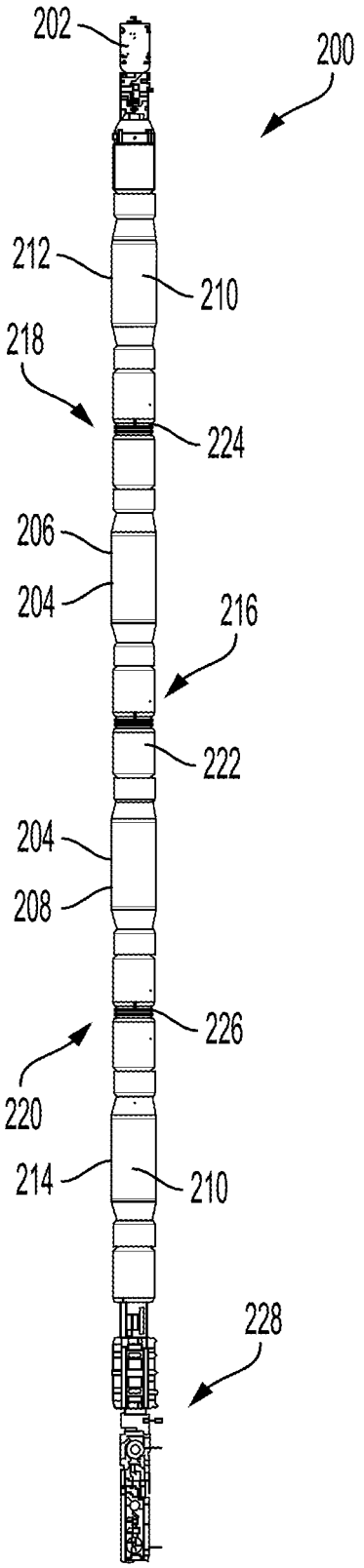
FIGS. 2-3 depict a well interval isolation device according to one example of the present disclosure.
Figure 3:
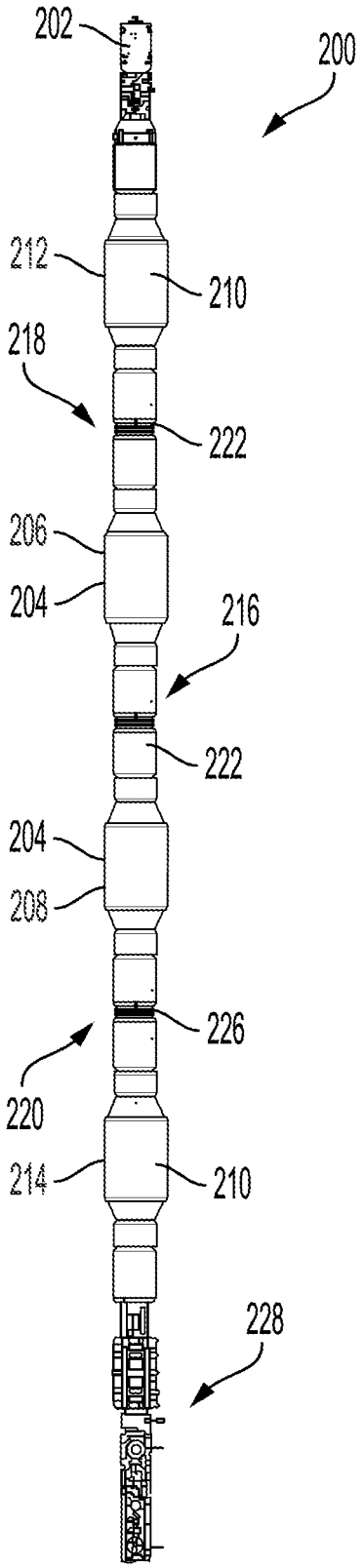

FIGS. 2-3 show the well interval isolation device 200 of FIG. 1 in more detail. As shown, this example of the well interval isolation device 200 is positionable downhole in a wellbore (e.g., the wellbore 106 of FIG. 1) as part of a tool string 202 that can be advanced into or retracted from a wellbore via tubing (e.g., tubing 114 of FIG. 1) conveyed by a rig (e.g., the rig 102 of FIG. 1) or another conveyance mechanism. Alternatively, the tool string 202 including the well interval isolation device 200, can be advanced into or retracted from the wellbore 106 via a wireline or a slickline conveyed by a wireline rigup (not shown).

The well interval isolation device 200 according to the example of FIGS. 2-3 includes a first expandable element 206 and a second expandable element 208 that form a first pair 204 of spaced apart expandable elements. The first expandable element 206 and the second expandable element 208 are respectively located near opposite (uphole and downhole) ends of a primary interval tool 222 to form a primary interval isolating section 216 of the well interval isolation device 200. The well interval isolation device 200 also includes at least a third expandable element 212 and a fourth expandable element 214 that form a second pair 210 of spaced apart expandable elements. The third expandable element 212 is positioned uphole of and at some distance from the first expandable element 206. The fourth expandable element 214 is positioned downhole of and at some distance from the second expandable element 208. In FIG. 2, each of the expandable elements 206, 208, 212, 214 of the well interval isolation device 200 is shown in a contracted (e.g., deflated) state. In FIG. 3, each of the expandable elements 206, 208, 212, 214 of the well interval isolation device 200 is shown in an expanded (e.g., inflated) state.

The first expandable element 206 and the second expandable element 208 may cooperate with the primary interval tool 222 to create a primary interval isolating section 216 of the well interval isolation device 200. The distance between the first expandable element 206 and the second expandable element 208 effectively defines the length of the primary interval isolating section 216. The third expandable element 212 may cooperate with the first expandable element 206 and a first uphole guard interval tool 224 to create a first uphole guard interval section 218 of the well interval isolation device 200, which may reside immediately uphole of the primary interval isolating section 216 as shown. The fourth expandable element 214 may cooperate with the second expandable element 208 and a first downhole guard interval tool 226 to create a first downhole guard interval section 220 of the well interval isolation device 200, which may reside immediately downhole of the primary interval isolating section 216 as shown.

Examples of the primary interval tool 222 can include a fluid extraction tool, a microfracturing tool, an acidizing tool, or another material emitting tool. The first uphole guard interval tool 224 and the first downhole guard interval tool 226 can be the same as or different than the primary interval tool 222. For example, the first uphole guard interval tool 224 and the first downhole guard interval tool 226 may be pressure reducing or pressure increasing devices. The primary interval tool can be operable independently of the first uphole guard interval tool 224 and the first downhole guard interval tool 226. Any or all of the primary interval tool 222, the first uphole guard interval tool 224, and the first downhole guard interval tool 226 may be equipped with one or more sensors. The one or more sensors may be configured detect pressure or various other conditions produced within a well interval corresponding to the primary interval isolating section 216 or the guard interval sections 218, 220 of the well interval isolation device 200. Various components such as but not limited to valves 228, etc., of the well interval isolation device 200 may be located between the fourth expandable element 214 and a remainder of the tool string 202, as indicated.

In FIG. 1, the well interval isolation device 200 is located within the open-hole portion of the wellbore 106 with the expandable elements 206, 208, 212, 214 of the well interval isolation device 200 expanded as shown in FIG. 3. As represented in FIG. 1, expansion of the expandable elements 206, 208, 212, 214 places the exterior surfaces thereof into sealing contact with the rock or other formation material forming the wall of the wellbore 106. In another example where the well interval isolation device 200 is located within a cased portion of a wellbore, each of the expandable elements 206, 208, 212, 214 can instead be placed into sealing contact with an inner wall of the casing.

It can be observed in FIG. 1 that the first expandable element 206 and the second expandable element 208 can cooperate to create a primary isolated well interval 150 within the wellbore 106. The first expandable element 206 and the third expandable element 212 can cooperate to create a first uphole guard interval 152 within the wellbore 106. Similarly, the second expandable element 208 and the fourth expandable element 214 can cooperate to create a first downhole guard interval 154 within the wellbore 106. The length of each interval 150, 152, 154, which is determined by the distance between the expandable elements 206, 208, 212, 214, is configurable and can be varied as desired or as required by a particular use case.

With the well interval isolation device 200 positioned within the wellbore 106 and the expandable elements 206, 208, 212, 214 expanded as indicated in FIG. 1, the tools 224, 226 of the respective guard interval sections 218, 220 of the well interval isolation device 200 can be used to decrease or increase the pressure within the respective first guard intervals 152, 154. In some examples, an increase or decrease in pressure within either or both of the first guard intervals 152, 154 may be a byproduct of performing a particular (e.g., sampling or microfracturing) operation with the corresponding guard interval tools 224, 226. In other examples, one or both of the guard interval tools 224, 226 may be used to purposefully increase or decrease the pressure within a corresponding first guard interval 152, 154. In either case, the pressure within the first guard intervals 152, 154 can be increased or decreased by some desired amount that does not cause the difference in pressure between either of the first guard intervals 152, 154 and the surrounding well fluid to exceed the differential pressure limit of any one of the expandable elements 206, 208, 212, 214. The pressure within the primary isolated well interval 150 can then also be correspondingly increased or decreased by some desired amount. The pressure within the primary isolated well interval 150 may be increased up to a level that does not cause the pressure difference between the primary isolated well interval 150 and either of the first guard intervals 152, 154 to exceed the differential pressure limit of either of the first pair 204 of spaced apart expandable elements 206, 208.

The first uphole guard interval 152 and the first downhole guard interval 154 form intermediate pressure stages that further isolate the primary isolated well interval 150 from the pressure and fluid in the remainder of the wellbore 106. As a result, the difference in pressure between the primary isolated well interval 150 and the hydrostatic pressure of the well fluid (i.e., the differential pressure) can safely exceed the maximum differential pressure at which any of the individual expandable elements 206, 208, 212, 214 can operate. For example, if the hydrostatic pressure of the well fluid at a given location in the wellbore 106 is 2,000 PSI and the maximum differential pressure at which any of the individual expandable elements 206, 208, 212, 214 of the well interval isolation device 200 can operate is 5,000 PSI, the pressure within the first uphole guard interval 152 and the first downhole guard interval 154 can be up to ±7,000 PSI. This allows the pressure within the primary isolated well interval 150 to be as much as ±12,000 PSI and results in a differential pressure of 10,000 PSI relative to the hydrostatic pressure of the well fluid. Thus, the creation and use of the first guard intervals 152, 154 in this example effectively doubles the maximum functional pressure difference that can be created between the primary isolated well interval 150 and the fluid in the wellbore 106.

The primary interval tool 222 associated with the primary interval isolating section 216 of the well interval isolation device 200 can be used to perform a desired operation within the primary isolated well interval 150 of the wellbore 106. In some examples, the operation may be a fluid extraction (drawdown) operation that results in a pressure reduction. Alternatively, the primary interval tool 222 can be used to perform an operation that results in a pressure increase. Non-limiting examples of a pressure-increasing (overpressure) operation include an acidizing or other material introduction operation, or a microfracturing operation. The first uphole guard interval tool 224 and the first downhole guard interval tool 226 may be used to perform similar operations. Alternatively, one or both of the first uphole guard interval tool 224 and the first downhole guard interval tool 226 may be used simply to effectuate a desired pressure change within the first uphole guard interval 152 or the first downhole guard interval 154. Once the desired operation(s) is complete, the expandable elements 206, 208, 212, 214 can be contracted (e.g., deflated) and the well interval isolation device 200 may be moved with the tool string 205 to another uphole or downhole target location or may be removed from the wellbore 106.

Figure 4:
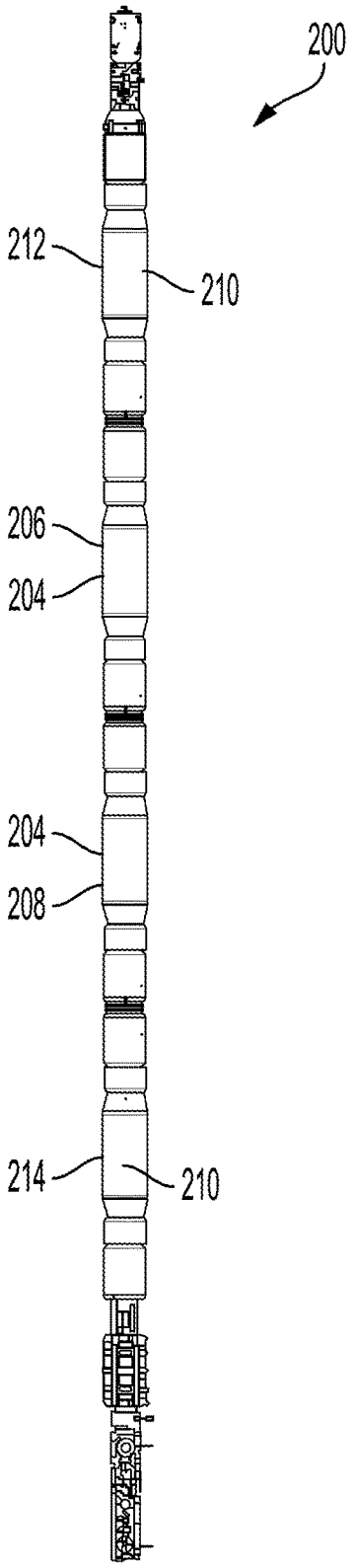
FIGS. 4-6 illustrate a well interval isolation device expansion element expansion sequence according to one example of the present disclosure.
Figure 5:
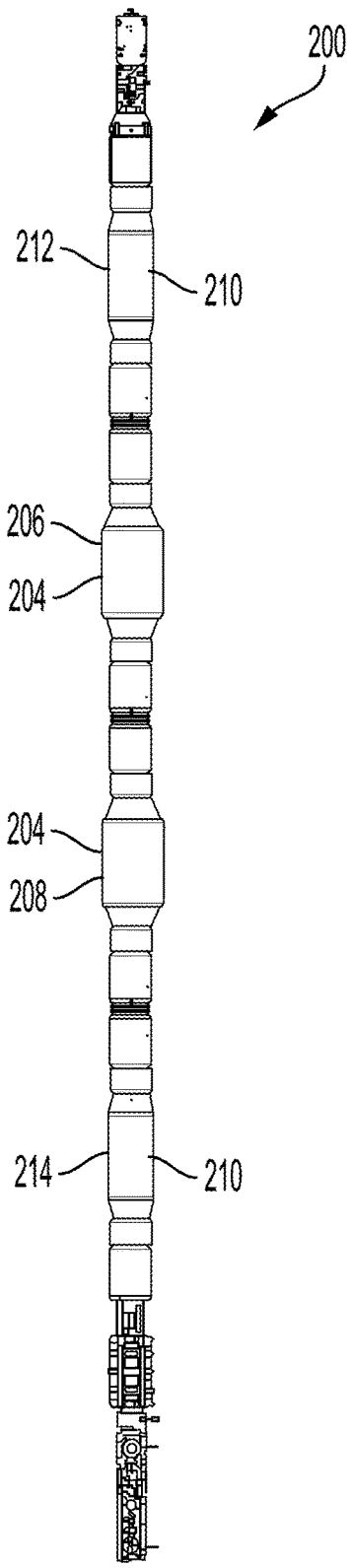
Figure 6:
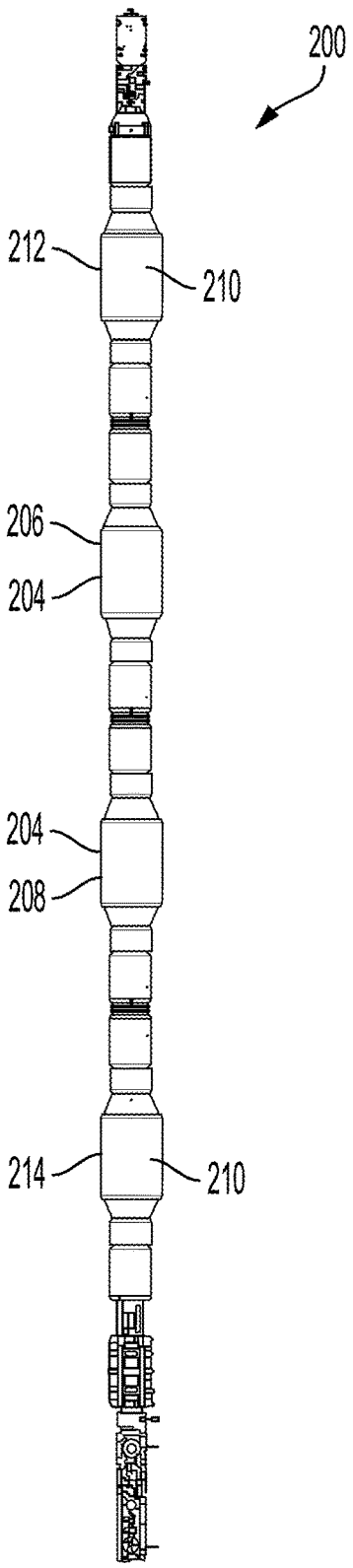

FIGS. 4-6 depict one example of an expansion order for the expandable elements 206, 208, 212, 214 of the well interval isolation device 200. The well interval isolation device 200 is shown in FIG. 4 in a state where each of the expandable elements 206, 208, 212, 214 is contracted, such as would normally be the case when the well interval isolation device 200 is being introduced to, moved within, or removed from the wellbore 106. FIG. 5 illustrates concurrent expansion of the first expandable element 206 and the second expandable element 208 of the first pair 204 of expandable elements after the well interval isolation device 200 has been placed at a target location within the wellbore 106. FIG. 6 illustrates subsequent concurrent expansion of the third expandable element 212 and the fourth expandable element 214 of the second pair 210 of expandable elements after expansion of the first expandable element 206 and the second expandable element 208. Thus, FIGS. 4-6 depict a center-out expansion order, where the first expandable element 206 and the second expandable element 208 on opposite sides of the primary interval isolating section 216 are concurrently expanded prior to concurrent expansion of the third expandable element 212 and the fourth expandable element 214. Such a center-out expansion order can help avoid expansion of the first expandable element 206 and the second expandable element 208 against a volume of well fluid that would likely be trapped between the third expandable element 212 and the fourth expandable element 214 if the third expandable element 212 and the fourth expandable element 214 are instead inflated first.

In other examples, the expandable elements 206, 208, 212, 214 of the well interval isolation device 200 may be expanded in a different order depending on conditions, pressures, etc., within the wellbore 106, an operation to be performed, or other parameters. For example, it may be possible to expand all the expandable elements 206, 208, 212, 214 of the well interval isolation device 200 simultaneously. Notwithstanding the potential issue of trapped well fluid, it may nonetheless be possible in some examples to expand the third expandable element 212 and the fourth expandable element 214 (i.e., the second pair 210 of expandable elements) before expanding the first expandable element 206 and the second expandable element 208 (i.e., the first pair 204 of expandable elements). According to another example, it is possible to concurrently expand the first expandable element 206 and the third expandable element 212 and to then concurrently expand the second expandable element 208 and the fourth expandable element 214, or vice versa.

According to still another example, it may be possible to expand the expandable elements 206, 208, 212, 214 individually and in various sequences. One non-limiting sequence of individual expandable element expansion may be a downhole-to-uphole sequence. In such an expansion sequence, the fourth expandable element 214 can be initially expanded, followed by the second expandable element 208, then the first expandable element 206, and lastly the third expandable element 212. While various orders of expandable element expansion are described and depicted herein, nothing in the present disclosure is to be interpreted as limiting expansion of the expandable elements 206, 208, 212, 214 to any specific order.

Expansion and contraction of the expandable elements 206, 208, 212, 214 of the well interval isolation device 200 can be accomplished in a variety of ways. For example, in a case where the expandable elements 206, 208, 212, 214 are inflatable expandable elements, such as inflatable packers, the expandable elements 206, 208, 212, 214 may be inflated and deflated by respectively supplying pressurized fluid to and extracting/expelling pressurized fluid from the expandable elements 206, 208, 212, 214. In another example, the expandable elements 206, 208, 212, 214 may instead be comprised of a deformable material such as an elastomeric material, and the expandable elements 206, 208, 212, 214 may be dynamically expanded such as through compression caused by linear translation of one or more of the components of the tool string 202.

In some examples of the well interval isolation device 200, the first expandable element may be hydraulically coupled to the second expandable element to enable simultaneous inflation of the first expandable element and the second expandable element and to allow the first expandable element and the second expandable element to be inflated independently of the third expandable element and the fourth expandable element. Similarly, in some examples of the well interval isolation device 200, the third expandable element may be hydraulically coupled to the fourth expandable element to enable simultaneous inflation of the third expandable element and the fourth expandable element and to allow the third expandable element and the fourth expandable element to be inflated independently of the first expandable element and the second expandable element. Likewise, the first uphole guard interval tool may be hydraulically coupled to the first downhole guard interval tool to enable simultaneous operation of the first uphole guard interval tool and the first downhole guard interval tool, and to allow the first uphole guard interval tool and the first downhole guard interval tool to be operated independently of the primary interval tool.

In an example, a bypass line can also be associated with the tool string to form a fluid pathway between a point uphole of the third expandable element and a point downhole of the fourth expandable element. In this manner, well fluid located uphole of the well interval isolation device 200 and well fluid located downhole of the well interval isolation device 200 may be placed in fluid communication.

Figure 7:
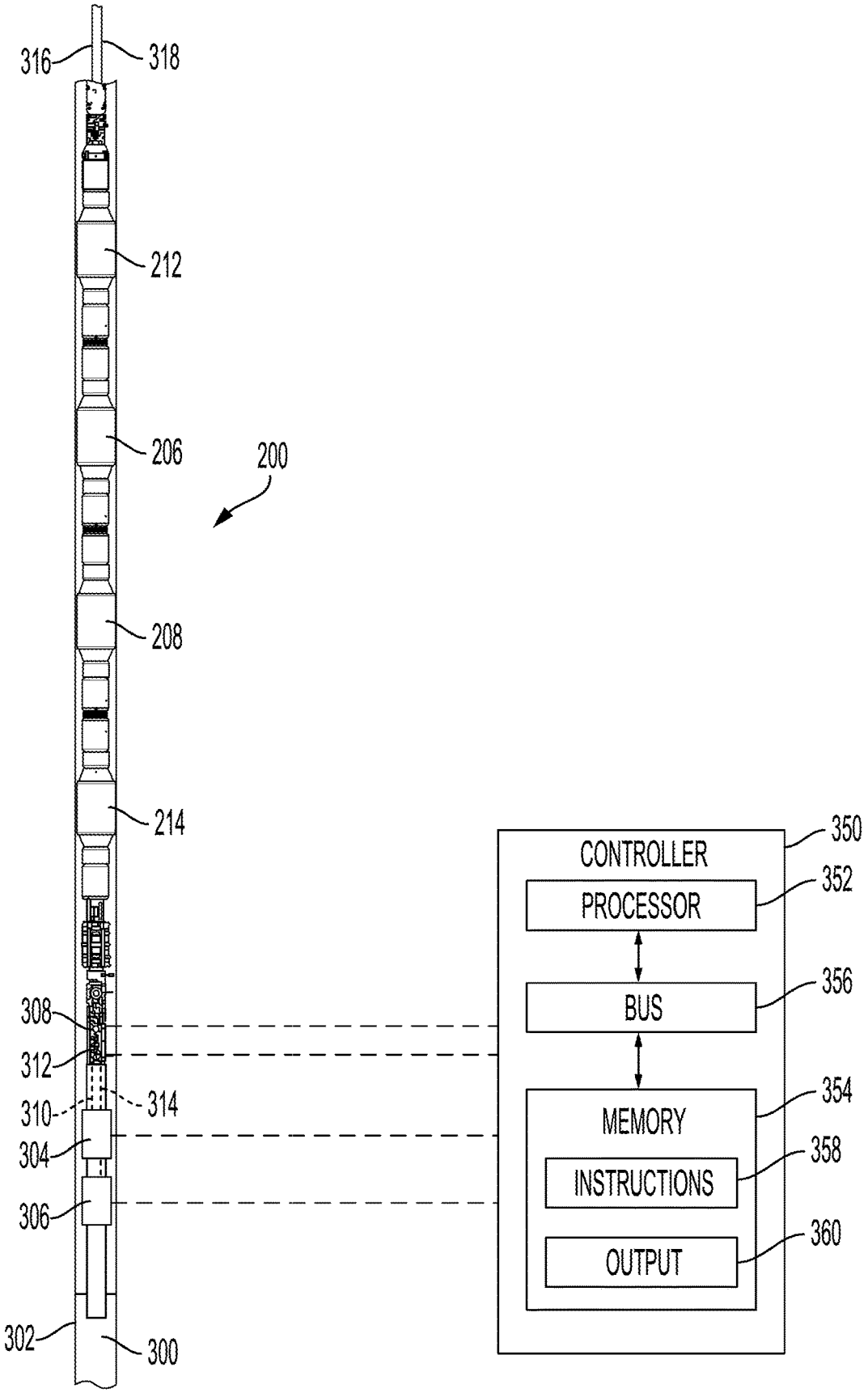
FIG. 7 schematically depicts a control system for use with a well interval isolation device according to one example of the present disclosure.

As is schematically represented in FIG. 7, when the expandable elements 206, 208, 212, 214 of the well interval isolation device 200 are inflatable packers or similar inflatable elements, fluid from a fluid source may be pressurized and used to inflate the expandable elements 206, 208, 212, 214. The fluid source can be downhole well fluid 300. The downhole well fluid 300 may be extracted from a wellbore 302 in which the well interval isolation device 200 is located and transmitted to the expandable elements 206, 208, 212, 214 under pressure for purposes of inflating the expandable elements. In some examples, the downhole well fluid may be pressurized and supplied to the expandable elements 206, 208, 212, 214 by at least one pump or similar fluid motive device. For example, as is schematically illustrated in FIG. 7, a first pump 304 and a second pump 306 can be used to inflate the expandable elements with downhole well fluid 300 extracted from the wellbore 302. The pumps 304, 306 may be part of the same tool string as the well interval isolation device 200. In some examples, fluid may also be extracted from the expandable elements 206, 208, 212, 214 by the pumps 304, 306 when deflation of the expandable elements 206, 208, 212, 214 is required.

In the example illustrated in FIG. 7, the first pump 304 may be in hydraulic communication with the well fluid 300, and also with a first valve 308 of the well interval isolation device 200. For example, a first pressurized fluid line 310 may travel within an open interior of the well interval isolation device 200 to hydraulically couple the first valve 308 to the first pump 304. The first pressurized fluid line 310 may also hydraulically couple the first valve 308 to the first expandable element 206 and the second expandable element 208. As such, the first pump 304 may be operated in combination with the first valve 308 to inflate (expand) the first expandable element 206 and the second expandable element 208 by transmitting pressurized well fluid 300 thereto.

Similarly, the second pump 306 may be in hydraulic communication with the well fluid 300, and also with a second valve 312 of the well interval isolation device 200. For example, a second pressurized fluid line 314 may travel within the open interior of the well interval isolation device 200 to hydraulically couple the second valve 312 to the second pump 306. The second pressurized fluid line 314 may also hydraulically couple the second valve 312 to the third expandable element 212 and the fourth expandable element 214. As such, the second pump 306 may be operated in combination with the second valve 312 to inflate (expand) the third expandable element 212 and the fourth expandable element 214 by transmitting pressurized well fluid 300 thereto.

Various other pumping configurations are also possible to achieve any of the expandable element expansion orders described above. For example, a single pump may be used with controllable valves, diverters, etc., to selectively deliver pressurized fluid to one or more of the expandable elements 206, 208, 212, 214.

In some examples, a primary interval tool supply line 316 may hydraulically couple the primary interval tool 222 to a pump or to a source of material at the well surface. For example, the primary interval tool supply line 316 may hydraulically couple the primary interval tool 222 to a source of micro-fracturing fluid, acidizing fluid, or another fluid at the well surface, and to a pump for delivering the fluid to the primary interval tool 222 under pressure. Similarly, a guard interval tool supply line 318 may hydraulically couple the first uphole guard interval tool 224 and the first downhole guard interval tool 226 to a pump or to a source of material at the well surface. For example, the guard interval tool supply line 318 may hydraulically couple the first uphole guard interval tool 224 and the first downhole guard interval tool 226 to a source of micro-fracturing fluid, acidizing fluid, or another fluid at the well surface, and to a pump for delivering the fluid to the first uphole guard interval tool 224 and the first downhole guard interval tool 226 under pressure. In other examples, the primary interval tool supply line 316 and the guard interval tool supply line 318 may instead hydraulically couple the primary interval tool 222, and the first uphole guard interval tool 224 and the first downhole guard interval tool 226, to the downhole well fluid 300 and to one or more downhole pumps for delivering pressurized well fluid to the primary interval tool 222, and the first uphole guard interval tool 224 and the first downhole guard interval tool 226. In such an example, the one or more downhole pumps may be the first pump 304 and the second pump 306. As with the pressurized fluid lines 310, 314, the primary interval tool supply line 316 and the guard interval tool supply line 318 may travel within an open interior portion of the well interval isolation device 200.

A controller 350 or a similar device may be provided to manage expansion and contraction of the expandable elements 206, 208, 212, 214. For example, the controller may be programmed to cause expansion of the expandable elements in a particular order. The controller 350 may be communicatively coupled to the pumps 304, 306, and may include inflation pressure sensors or may receive signals from downhole inflation pressure sensors associated with the expandable elements 206, 208, 212, 214. The controller 350 may provide output 360 in the form of commands that are used to control the pumps 304, 306, and possibly other devices or components related to the inflation and deflation of the expandable elements 206, 208, 212, 214 of the well interval isolation device 200. The controller 350 may also control operation of the tools 222, 224, 226 of the well interval isolation device 200, or another controller may be provided for that purpose. The tools 222, 224, 226 may include at least pressure sensors that report to the controller the pressure within the respective well isolation intervals created within the wellbore 106 by the well interval isolation device 200. Alternatively, separate sensors may be provided for that purpose in other examples.

The controller 350 can include a processor 352 that may be communicatively coupled to a memory 354, such as by a bus 356. The processor 352 can include one processor or multiple processors. Non-limiting examples of the processor 352 include a Field-Programmable Gate Array (FPGA), an application specific integrated circuit (ASIC), a microprocessor, or any combination of these.

Instructions 358 may be stored in the memory 354. The instructions 358 are executable by the processor 352 for causing the processor 352 to perform various operations. In some examples, the instructions 358 can include processor-specific instructions generated by a compiler or an interpreter from code written in any suitable computer-programming language, such as C, C++, C#, Java, or Python. Through the instructions 358, the processor 352 may operate as described above to perform the various operations of the controller 350 related managing inflation and deflation of the expandable elements 206, 208, 212, 214 of the well interval isolation device 200.

The memory 354 can include one memory device or multiple memory devices. The memory 354 can be non-volatile and may include any type of memory device that retains stored information when powered off. Non-limiting examples of the memory 354 include electrically erasable and programmable read-only memory (EEPROM), flash memory, or any other type of non-volatile memory. At least some of the memory device includes a non-transitory computer-readable medium from which the processor 352 can read the instructions 358. A non-transitory computer-readable medium can include electronic, optical, magnetic, or other storage devices capable of providing the processor 352 with the instructions 358 or other program code. Non-limiting examples of a non-transitory computer-readable medium include magnetic disk(s), memory chip(s), ROM, random-access memory (RAM), an ASIC, a configured processor, optical storage, or any other medium from which a computer processor can read the instructions 358.

Figure 8:
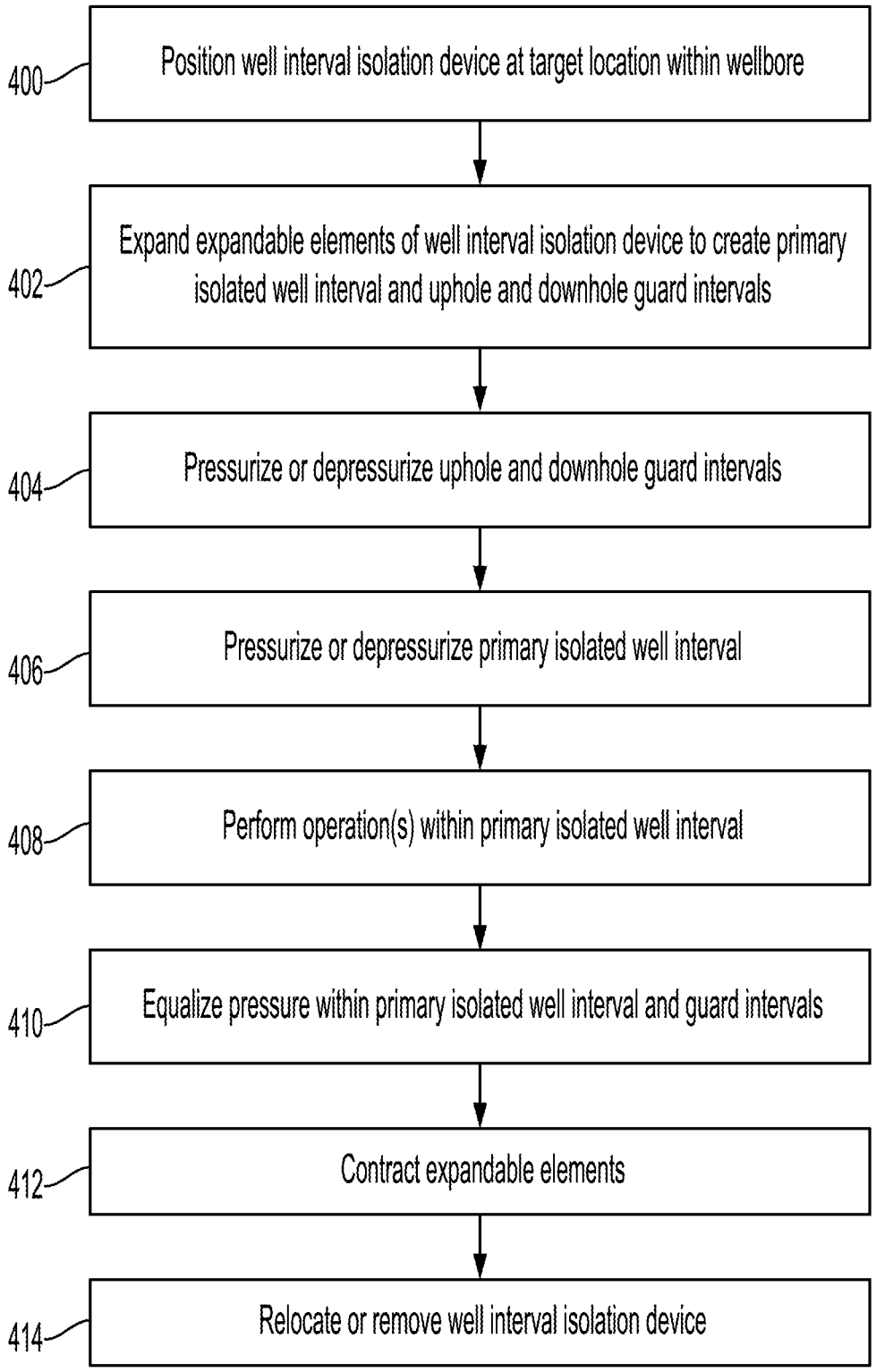
FIG. 8 is a flow chart of a method for isolating a primary well interval of a hydrocarbon well according to one example of the present disclosure.

FIG. 8 is a flowchart of a method of creating a primary isolated well interval using an example of a well interval isolation device. In this example, the well interval isolation device includes at least a first pair of expandable elements and a second pair of expandable elements distributed along a tool string in accordance with the previously provided description.

It can be observed from FIG. 8 at block 400, that the well interval isolation device can be positioned at a target location within a wellbore, such as within an open hole portion of a wellbore. The wellbore may have one or more of a vertical portion, a horizontal portion, or a deviated portion. In some examples, the well interval isolation device may be operated in any of these wellbore portions.

As described above, the well interval isolation device may comprise a first expandable element and a second expandable element that are spaced apart on a tool string. The first expandable element and the second expandable element may be located near opposite uphole and downhole ends of a primary interval tool to form a primary interval isolating section of the well interval isolation device. The well interval isolation device may also comprise at least a third expandable element that is positioned uphole of and at some distance from the first expandable element, and a fourth expandable element that is positioned downhole of and at some distance from the second expandable element. The third expandable element may cooperate with the first expandable element and an uphole guard interval tool to create a first uphole guard interval section of the well interval isolation device. Likewise, the fourth expandable element may cooperate with the second expandable element and a downhole guard interval tool to create a first downhole guard interval section of the well interval isolation device.

In some examples, the expandable elements may be inflatable elements, such as inflatable packers, which can be expanded using pressurized fluid. For example, the expandable elements may be expanded by using one or more pumps located at the well surface to transmit pressurized fluid to the downhole expandable elements of the well interval isolation device. In other examples, the expandable elements may be deformable elastomeric elements, which can be expanded by compression or a similar deforming force as described above.

At block 402, the expandable elements of the well interval isolation device can be expanded to create within the wellbore, a primary isolated well interval bounded on an uphole side thereof by a first uphole guard interval and bounded on a downhole side thereof by a first downhole guard interval. The expansion order of the expandable elements may vary in different examples, and may include at least any of the previously described expansion orders. The first uphole guard interval and the first downhole guard interval serve to further isolate the primary isolated well interval from well fluid present in the wellbore, and from the hydrostatic pressure associated with the well fluid. The well fluid may be drilling mud, various fluids that have seeped into the wellbore from a surrounding formation, other fluids that have been introduced to the wellbore, or any combination thereof.

In this example, once the expandable elements have been expanded, the pressure in each of the uphole guard interval and the downhole guard interval may be simultaneously increased or decreased to a desired pressure level, as indicated at block 404. For example, the pressures may be increased or decreased to approximately one half of a desired working pressure (e.g., 5 ksi for a 10 ksi operation). While doing so, the pressure of the primary isolated well interval may permissibly vary if not vented to the wellbore. The upper limit of the pressure attainable within the guard intervals is most typically dictated by the differential pressure rating of the expandable elements. As indicated at block 406, the pressure in the primary isolated well interval can then be increased or decreased to a desired pressure level. For example, while actively maintaining the pressure within the guard intervals at a target (desired) level, the pressure within the primary isolated well interval can be increased or decreased as needed to achieve a desired working pressure (pressure level). The upper limit of the pressure within the primary isolated well interval can exceed the differential pressure rating of the individual expandable elements. For example, the upper limit of the pressure within the primary isolated well interval may be double the differential pressure rating of the individual expandable elements. In some examples, the upper limit of the pressure within the primary isolated well interval may instead be determined by an allowable mandrel pressure rating associated with the well interval isolation device. The primary interval tool, the uphole guard interval tool, and the downhole guard interval tool may each include a pressure sensor positionable to report isolated well interval pressure readings during pressurization or depressurization thereof.

With the pressures within the guard intervals and the primary isolated well interval maintained at desired levels, one or more operations may be performed in or on the wellbore within the primary isolated well interval, as indicated at block 406. For example, the primary interval tool of the well interval isolation device may be used to perform a drawdown or overpressure operation within the primary isolated well interval. In some examples, a drawdown operation may be a fluid extraction operation, whereby a sample of well fluid is removed from the wellbore within the primary isolated well interval and concurrently or subsequently transported to the well surface for analysis. Similarly, the primary interval tool of the well interval isolation device may be used to perform a focus sampling operation, whereby a target fluid that is encapsulated within another fluid in the wellbore is extracted from the encapsulating fluid. The pressure within the primary isolated well interval is reduced as a result of a drawdown operation. Alternatively, the primary interval tool of the well interval isolation device may be used to perform an overpressure operation. One example of an overpressure operation is a microfracturing operation, whereby pressurized fluid is directed into the formation wall to produce microfractures therein. The produced microfractures can be analyzed to, for example, ascertain information about the formation or about a current fracturing operation, as well as to adjust parameters of a fracturing operation. Another example of an overpressure operation is an acidizing operation, whereby a pressurized acid composition may be introduced to the formation for the purpose of improving production. In any case, the pressure within the primary isolated well interval is increased as a result of an overpressure operation.

As indicated at block 410, after an operation(s) within the primary isolated well interval is complete, the pressures within the primary isolated well interval and the first uphole and first downhole guard intervals can be equalized prior to contraction of the expandable elements. Equalizing the pressures, as used herein, means returning the pressures within the primary isolated well interval and the first uphole and first downhole guard intervals to a level where the difference in pressure between the primary isolated well interval and the well fluid within the wellbore does not exceed the maximum allowable differential pressure of any of the expandable elements. In one example, the pressure within the primary isolated well interval can be returned to an acceptable level, followed by the pressure within each of the guard intervals. In another example, it may be possible to simultaneously equalize the pressure in the primary isolated well interval and each of the guard intervals, as long as the difference in pressure between the primary isolated well interval and the well fluid within the wellbore does not exceed the maximum allowable differential pressure of any of the expandable elements.

As indicated at block 412, once the pressures within the primary isolated well interval and the guard intervals has been sufficiently equalized, the expandable elements can be contracted. In the case of inflatable expandable elements, for example, contraction may be accomplished by operating the aforementioned pumps in reverse fashion to extract fluid from the expandable elements. The extracted fluid may be returned to a fluid source location in some examples. The expandable elements may be contracted in various orders. In one example, the expandable elements can be contracted in pairs, such by contracting the first expandable element and the second expandable element followed by contracting the third expandable element and the fourth expandable element, or vice versa. Alternatively, the expandable elements may be contracted individually, such as for example in an uphole-to-downhole or a downhole-to-uphole order. Other expandable element contraction element orders are also possible.

With the expandable elements contracted, the well interval isolation device can then be relocated or removed from the wellbore, as represented at block 414. For example, the well interval isolation device may be moved to a different target location within the wellbore to perform another drawdown or overpressure operation.

For purposes of illustration, well interval isolation device examples have been described as having first, second, third, and fourth expandable elements that are arranged and cooperate to create within a wellbore a primary isolated well interval bounded on an uphole side thereof by a first uphole guard interval and bounded on a downhole side thereof by a first downhole guard interval. It should be realized, however, that an even greater allowable differential pressure between the primary isolated well interval and a well fluid can be achieved by utilizing further expandable elements (e.g., an additional uphole expandable element and an additional downhole expandable element) to create additional guard intervals uphole of the first uphole guard interval and downhole of the first downhole guard interval. Therefore, while the present disclosure describes examples of a well interval isolation device as having only four expandable elements and creating only two guard intervals, nothing in the disclosure is to be interpreted as preventing a well interval isolation device from having a greater number of expandable elements and creating more than two guard intervals within a wellbore during use.

According to aspects of the present disclosure, a well interval isolation device, a well interval isolation system, and a method, are provided according to one or more of the following examples. As used below, any reference to a series of examples is to be understood as a reference to each of those examples disjunctively (e.g., "Examples 1-4" is to be understood as "Examples 1, 2, 3, or 4").

Example 1 is a well interval isolation device comprising: a first, uphole expandable element, and a second, downhole expandable element spaced apart on a tool string and cooperating with a primary interval tool to form a primary interval isolating section of the well interval isolation device; a third expandable element positioned on the tool string uphole of the first expandable element and cooperating with the first expandable element and a first uphole guard interval tool to form a first uphole guard interval section of the well interval isolation device; and a fourth expandable element positioned on the tool string downhole of the second expandable element and cooperating with the second expandable element and a first downhole guard interval tool to form a first downhole guard interval section of the well interval isolation device; wherein, the first expandable element and the second expandable element are expandable independently of the third expandable element and the fourth expandable element, and the primary interval tool is operable independently of the first uphole guard interval tool and the first downhole guard interval tool.

Example 2 is the well interval isolation device of example 1, wherein: the first expandable element and the second expandable element are hydraulically coupled to enable expansion of the first expandable element and the second expandable element independently of the third expandable element and the fourth expandable element; the third expandable element and the fourth expandable element are hydraulically coupled to enable expansion of the third expandable element and the fourth expandable element independently of the first expandable element and the second expandable element; and the first uphole guard interval tool and the first downhole guard interval tool are hydraulically coupled to enable operation of the first uphole guard interval tool and the first downhole guard interval tool independently of the primary interval tool.

Example 3 is the well interval isolation device of example 1, further comprising a bypass line associated with the tool string and forming a fluid pathway between a point uphole of the third expandable element and a point downhole of the fourth expandable element.

Example 4 is the well interval isolation device of example 1, wherein: the primary interval tool is selected from the group consisting of a fluid extraction tool, a microfracturing tool, and an acidizing tool; and the first uphole guard interval tool and the first downhole guard interval tool are usable to decrease a pressure within an isolated well interval, increase a pressure within an isolated well interval, or both.

Example 5 is the well interval isolation device of example 1, wherein the primary interval tool, the uphole guard interval tool, and the downhole guard interval tool each include a pressure sensor for providing isolated well interval pressure readings.

Example 6 is the well interval isolation device of example 1, wherein the expandable elements are selected from the group consisting of inflatable packers and deformable elastomeric elements.

Example 7 is a well interval isolation system comprising: a well interval isolation device positionable downhole in a wellbore and comprising: a first, uphole expandable element, and a second, downhole expandable element spaced apart on a tool string and cooperating with a primary interval tool to form a primary interval isolating section of the well interval isolation device; a third expandable element positioned on the tool string uphole of the first expandable element and cooperating with the first expandable element and a first uphole guard interval tool to form a first uphole guard interval section of the well interval isolation device; and a fourth expandable element positioned on the tool string downhole of the second expandable element and cooperating with the second expandable element and a first downhole guard interval tool to form a first downhole guard interval section of the well interval isolation device; wherein, the first expandable element and the second expandable element are expandable independently of the third expandable element and the fourth expandable element, and the primary interval tool is operable independently of the first uphole guard interval tool and the first downhole guard interval tool; at least one pump in hydraulic communication with a fluid source and the expandable elements of the well interval isolation device, the at least one pump operable to expand the expandable elements by transmitting pressurized fluid to the expandable elements.

Example 8 is the well interval isolation system of example 7, wherein the fluid source is downhole well fluid.

Example 9 is the well interval isolation system of example 7, wherein: a first pump and source of material are hydraulically coupled to the primary interval tool by a primary interval tool supply line; a second pump and source of material are hydraulically coupled to the first uphole guard interval tool and the first downhole guard interval tool by a guard interval tool supply line; and a bypass line is associated with the tool string and forms a fluid pathway between a point uphole of the third expandable element and a point downhole of the fourth expandable element.

Example 10 is the well interval isolation system of example 7, wherein: a first pump is hydraulically coupled between a fluid source and a first valve by a first pressurized fluid line, the first pressurized fluid line further hydraulically coupling the first valve to the first expandable element and the second expandable element to enable expansion of the first expandable element and the second expandable element independently of the third expandable element and the fourth expandable element; a second pump hydraulically coupled between the fluid source and a second valve by a second pressurized fluid line, the second pressurized fluid line further hydraulically coupling the second valve to the third expandable element and the fourth expandable element to enable expansion of the third expandable element and the fourth expandable element independently of the first expandable element and the second expandable element.

Example 11 is the well interval isolation system of example 7, wherein: the primary interval tool is selected from the group consisting of a fluid extraction tool, an acidizing tool, and a microfracturing tool; and the primary interval tool, the uphole guard interval tool, and the downhole guard interval tool each include a pressure sensor for providing isolated well interval pressure readings.

Example 12 is the well interval isolation system of example 7, wherein the expandable elements are selected from the group consisting of inflatable packers and deformable elastomeric elements.

Example 13 is the well interval isolation system of example 7, further comprising a controller communicatively coupled to the at least one pump and operable to manage expansion and contraction of the expandable elements of the well interval isolation device.

Example 14 is the well interval isolation system of example 13, wherein the controller is programmed to: first cause the fourth expandable element to be expanded; cause the second expandable element to be expanded after causing the fourth expandable element to be expanded; cause the first expandable element to be expanded after causing the second expandable element to be expanded; and lastly, cause the third expandable element to be expanded.

Example 15 is a method comprising: positioning a well interval isolation device at a target location within a wellbore, the well interval isolation device comprising: a first, uphole expandable element, and a second, downhole expandable element spaced apart on a tool string and cooperating with a primary interval tool to form a primary interval isolating section of the well interval isolation device; a third expandable element positioned on the tool string uphole of the first expandable element and cooperating with the first expandable element and a first uphole guard interval tool to form a first uphole guard interval section of the well interval isolation device; and a fourth expandable element positioned on the tool string downhole of the second expandable element and cooperating with the second expandable element and a first downhole guard interval tool to form a first downhole guard interval section of the well interval isolation device; expanding the first expandable element and the second expandable element independently of the third expandable element and the fourth expandable element to create, within the wellbore, a primary isolated well interval bounded on an uphole side thereof by a first uphole guard interval and bounded on a downhole side thereof by a first downhole guard interval; operating the first uphole guard interval tool and the first downhole guard interval tool to respectively pressurize or depressurize the first uphole guard interval and the first downhole guard interval to a desired pressure level; and independently operating the primary interval tool to correspondingly pressurize or depressurize the primary isolated well interval to a pressure level that exceeds the pressure level of the first uphole guard interval and the first downhole guard interval.

Example 16 is the method of example 15, wherein a difference between the pressure level within the primary isolated well interval and a hydrostatic pressure of well fluid in the wellbore exceeds a maximum allowable differential pressure associated with one or more of the expandable elements, while isolation of each of the primary isolated well interval, the first uphole guard interval, and the first downhole guard interval from the well fluid is maintained.

Example 17 is the method of example 15, wherein the first expandable element and the second expandable element are simultaneously expanded, and thereafter the third expandable element and the fourth expandable element are simultaneously expanded.

Example 18 is the method of example 15, wherein: the fourth expandable element is initially expanded; the second expandable element is expanded after the fourth expandable element is expanded; the first expandable element is expanded after the second expandable element is expanded; and the third expandable element is expanded after the first expandable element is expanded.

Example 19 is the method of example 15, wherein: the first uphole guard interval and the first downhole guard interval are pressurized or depressurized to the desired pressure level; and the primary isolated well interval is pressurized to a pressure level that exceeds the pressure level of the first uphole guard interval and the first downhole guard interval, and causes a difference in pressure between the primary isolated well interval and a hydrostatic pressure of well fluid in the wellbore to exceed a maximum allowable differential pressure associated with one or more of the expandable elements.

Example 20 is the method of example 15, further comprising performing an operation selected from the group consisting of a fluid extraction operation, an acidizing operation, and a microfracturing operation within the primary isolated well interval after pressurizing or depressurizing each of the first uphole guard interval and the first downhole guard interval.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A well interval isolation device comprising:

a first, uphole expandable element, and a second, downhole expandable element spaced apart on a tool string and cooperating with a primary interval tool to form a primary interval isolating section of the well interval isolation device;

a third expandable element positioned on the tool string uphole of the first expandable element and cooperating with the first expandable element and a first uphole guard interval tool to form a first uphole guard interval section of the well interval isolation device; and a fourth expandable element positioned on the tool string downhole of the second expandable element and cooperating with the second expandable element and a first downhole guard interval tool to form a first downhole guard interval section of the well interval isolation device;

wherein, the first expandable element and the second expandable element are expandable independently of the third expandable element and the fourth expandable element, and the primary interval tool is operable independently of the first uphole guard interval tool and the first downhole guard interval tool.

2. The well interval isolation device of claim 1, wherein:

the first expandable element and the second expandable element are hydraulically coupled to enable expansion of the first expandable element and the second expandable element independently of the third expandable element and the fourth expandable element;

the third expandable element and the fourth expandable element are hydraulically coupled to enable expansion of the third expandable element and the fourth expandable element independently of the first expandable element and the second expandable element; and the first uphole guard interval tool and the first downhole guard interval tool are hydraulically coupled to enable operation of the first uphole guard interval tool and the first downhole guard interval tool independently of the primary interval tool.

3. The well interval isolation device of claim 1, further comprising a bypass line associated with the tool string and forming a fluid pathway between a point uphole of the third expandable element and a point downhole of the fourth expandable element.

4. The well interval isolation device of claim 1, wherein:

the primary interval tool is selected from the group consisting of a fluid extraction tool, a microfracturing tool, and an acidizing tool; and the first uphole guard interval tool and the first downhole guard interval tool are usable to decrease a pressure within an isolated well interval, increase a pressure within an isolated well interval, or both.

5. The well interval isolation device of claim 1, wherein the primary interval tool, the uphole guard interval tool, and the downhole guard interval tool each include a pressure sensor for providing isolated well interval pressure readings.

6. The well interval isolation device of claim 1, wherein the expandable elements are selected from the group consisting of inflatable packers and deformable elastomeric elements.

7. A well interval isolation system comprising:

a well interval isolation device positionable downhole in a wellbore and comprising:

a first, uphole expandable element, and a second, downhole expandable element spaced apart on a tool string and cooperating with a primary interval tool to form a primary interval isolating section of the well interval isolation device;

a third expandable element positioned on the tool string uphole of the first expandable element and cooperating with the first expandable element and a first uphole guard interval tool to form a first uphole guard interval section of the well interval isolation device; and a fourth expandable element positioned on the tool string downhole of the second expandable element and cooperating with the second expandable element and a first downhole guard interval tool to form a first downhole guard interval section of the well interval isolation device;

wherein, the first expandable element and the second expandable element are expandable independently of the third expandable element and the fourth expandable element, and the primary interval tool is operable independently of the first uphole guard interval tool and the first downhole guard interval tool; and at least one pump in hydraulic communication with a fluid source and the expandable elements of the well interval isolation device, the at least one pump operable to expand the expandable elements by transmitting pressurized fluid to the expandable elements.

8. The well interval isolation system of claim 7, wherein the fluid source is downhole well fluid.

9. The well interval isolation system of claim 7, wherein:

a first pump and source of material are hydraulically coupled to the primary interval tool by a primary interval tool supply line;

a second pump and source of material are hydraulically coupled to the first uphole guard interval tool and the first downhole guard interval tool by a guard interval tool supply line; and a bypass line is associated with the tool string and forms a fluid pathway between a point uphole of the third expandable element and a point downhole of the fourth expandable element.

10. The well interval isolation system of claim 7, wherein:

a first pump is hydraulically coupled between a fluid source and a first valve by a first pressurized fluid line, the first pressurized fluid line further hydraulically coupling the first valve to the first expandable element and the second expandable element to enable expansion of the first expandable element and the second expandable element independently of the third expandable element and the fourth expandable element;

a second pump hydraulically coupled between the fluid source and a second valve by a second pressurized fluid line, the second pressurized fluid line further hydraulically coupling the second valve to the third expandable element and the fourth expandable element to enable expansion of the third expandable element and the fourth expandable element independently of the first expandable element and the second expandable element.

11. The well interval isolation system of claim 7, wherein:

the primary interval tool is selected from the group consisting of a fluid extraction tool, an acidizing tool, and a microfracturing tool; and the primary interval tool, the uphole guard interval tool, and the downhole guard interval tool each include a pressure sensor for providing isolated well interval pressure readings.

12. The well interval isolation system of claim 7, wherein the expandable elements are selected from the group consisting of inflatable packers and deformable elastomeric elements.

13. The well interval isolation system of claim 7, further comprising a controller communicatively coupled to the at least one pump and operable to manage expansion and contraction of the expandable elements of the well interval isolation device.

14. The well interval isolation system of claim 13, wherein the controller is programmed to:

first cause the fourth expandable element to be expanded;

cause the second expandable element to be expanded after causing the fourth expandable element to be expanded;

cause the first expandable element to be expanded after causing the second expandable element to be expanded; and lastly, cause the third expandable element to be expanded.

15. A method comprising:

positioning a well interval isolation device at a target location within a wellbore, the well interval isolation device comprising:

a first, uphole expandable element, and a second, downhole expandable element spaced apart on a tool string and cooperating with a primary interval tool to form a primary interval isolating section of the well interval isolation device;

a third expandable element positioned on the tool string uphole of the first expandable element and cooperating with the first expandable element and a first uphole guard interval tool to form a first uphole guard interval section of the well interval isolation device; and a fourth expandable element positioned on the tool string downhole of the second expandable element and cooperating with the second expandable element and a first downhole guard interval tool to form a first downhole guard interval section of the well interval isolation device;

expanding the first expandable element and the second expandable element independently of the third expandable element and the fourth expandable element to create, within the wellbore, a primary isolated well interval bounded on an uphole side thereof by a first uphole guard interval and bounded on a downhole side thereof by a first downhole guard interval;

operating the first uphole guard interval tool and the first downhole guard interval tool to respectively pressurize or depressurize the first uphole guard interval and the first downhole guard interval to a desired pressure level; and independently operating the primary interval tool to correspondingly pressurize or depressurize the primary isolated well interval to a pressure level that exceeds the pressure level of the first uphole guard interval and the first downhole guard interval.

16. The method of claim 15, wherein a difference between the pressure level within the primary isolated well interval and a hydrostatic pressure of well fluid in the wellbore exceeds a maximum allowable differential pressure associated with one or more of the expandable elements, while isolation of each of the primary isolated well interval, the first uphole guard interval, and the first downhole guard interval from the well fluid is maintained.

17. The method of claim 15, wherein the first expandable element and the second expandable element are simultaneously expanded, and thereafter the third expandable element and the fourth expandable element are simultaneously expanded.

18. The method of claim 15, wherein:

the fourth expandable element is initially expanded;

the second expandable element is expanded after the fourth expandable element is expanded;

the first expandable element is expanded after the second expandable element is expanded; and the third expandable element is expanded after the first expandable element is expanded.

19. The method of claim 15, wherein:

the first uphole guard interval and the first downhole guard interval are pressurized or depressurized to the desired pressure level; and the primary isolated well interval is pressurized to a pressure level that exceeds the pressure level of the first uphole guard interval and the first downhole guard interval, and causes a difference in pressure between the primary isolated well interval and a hydrostatic pressure of well fluid in the wellbore to exceed a maximum allowable differential pressure associated with one or more of the expandable elements.

20. The method of claim 15, further comprising performing an operation selected from the group consisting of a fluid extraction operation, an acidizing operation, and a microfracturing operation within the primary isolated well interval after pressurizing or depressurizing each of the first uphole guard interval and the first downhole guard interval.

* * * * *